US005327654A

United States Patent [19]

Parker

[11] Patent Number: 5,327,654

[45] Date of Patent: Jul. 12, 1994

[54] GUN SIGHT

[76] Inventor: Joseph S. Parker, P.O. Box 690, Murrells Inlet, S.C. 29576

[21] Appl. No.: 69,377

[22] Filed: Jun. 1, 1993

Related U.S. Application Data

[63] Continuation of Ser. No. 533,031, Dec. 20, 1989, abandoned.

[51] Int. Cl.[5] ..... F41G 1/01; F41G 1/033; F41G 1/10

[52] U.S. Cl. ..... 33/258; 33/242; 33/254

[58] Field of Search ..... 33/241, 242, 244, 251, 33/252, 253, 254, 255, 256, 257, 258, 259, 260, 261; 42/100, 102

[56] References Cited

U.S. PATENT DOCUMENTS

| | | | |
|---|---|---|---|
| 607,344 | 7/1898 | Cooper | 33/243 |
| 783,540 | 2/1905 | Pratt | 33/253 |
| 811,267 | 1/1906 | Andrus | 33/259 |
| 893,751 | 7/1908 | Putwey | 33/251 |
| 1,161,281 | 11/1915 | Barnes et al. | 33/255 |
| 1,198,295 | 9/1916 | Ward | 33/253 |
| 1,198,888 | 9/1916 | Bullen | 33/251 |
| 1,265,266 | 5/1919 | Simpson | 33/255 |
| 1,428,389 | 9/1922 | Miller | 33/251 |
| 1,755,635 | 4/1930 | Dindinger | 33/243 |
| 1,759,012 | 5/1930 | Kauch et al. | 33/251 |
| 1,850,288 | 3/1932 | Robbins | 33/251 |
| 1,857,782 | 5/1932 | Herman | 33/251 |
| 2,039,907 | 5/1936 | Jefferson | 42/100 |
| 2,246,174 | 6/1941 | Howells | 33/241 |
| 2,256,411 | 9/1941 | Russell | 33/241 |
| 2,310,929 | 2/1943 | Beresky | 33/251 |
| 2,333,514 | 11/1943 | Beresky | 33/251 |
| 2,339,723 | 1/1944 | Russell | 33/241 |
| 2,566,590 | 9/1951 | Trippi | 33/243 |
| 2,615,252 | 10/1952 | Wing | 33/242 |
| 2,806,288 | 9/1957 | Sarvis | 33/254 |
| 2,825,137 | 3/1958 | Meetin | 33/252 |
| 2,932,896 | 4/1960 | Hicinbottem | 42/100 |
| 3,098,303 | 7/1963 | Plisk | 33/241 |
| 3,187,436 | 6/1965 | Friedrichsmeier | 42/100 |
| 3,439,970 | 4/1969 | Rickert | 33/233 |

FOREIGN PATENT DOCUMENTS

| | | | |
|---|---|---|---|
| 578932 | 7/1959 | Canada | 33/251 |
| 0396108 | 7/1933 | United Kingdom | 33/251 |

*Primary Examiner*—Thomas B. Will

[57] ABSTRACT

A gun sight for rifles, pistols, or shotguns which is particularly useful on rapid fire weapons, such as semi-automatic rifles and pistols used by the public, or fully automatic weapons used by the military. The gun sight consists of a rear sight and a front sight. The rear sight consists of a base, two side walls, and a top joined together. The top has a rectangular channel cut into it. The front sight consists of a small threaded rod affixed to a small tube and a base which is attached to the barrel of the gun. The small threaded rod then adjusts upward and downward in a small hole drilled in the top of the base.

3 Claims, 1 Drawing Sheet

FIG. 1
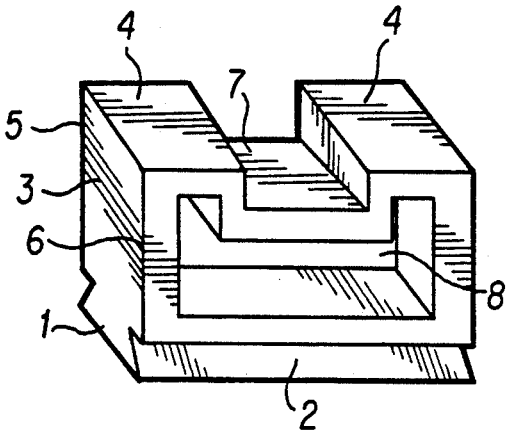
FIG. 2
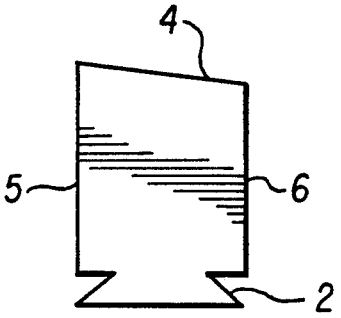
FIG. 3
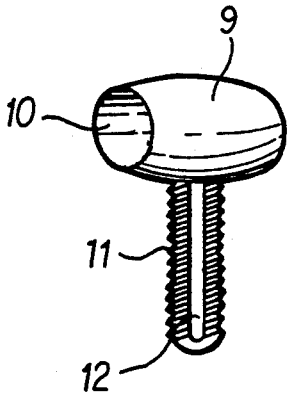
FIG. 4
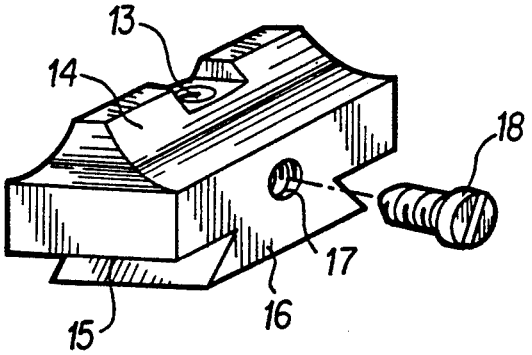
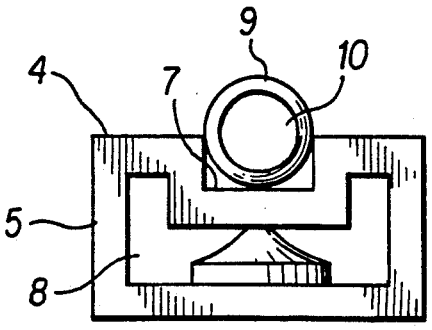
FIG. 5

GUN SIGHT

REFERENCES TO RELATED APPLICATIONS

This application is a continuation of the application with Ser. No. 07/533,031 which was filed on Dec. 20, 1989 now abandoned. The earlier filing date of this application is hereby claimed.

BACKGROUND OF THE INVENTION

This invention relates to gun sights that are used on firearms such rifles, pistols, or shotguns. It is well suited for rapid fire weapons such as semi-automatic rifles and pistols, or fully-automatic weapons used by the military.

Gun sights are devices attached to a gun which aid the shooter in aiming the gun at a target. The sights most commonly used on rifles and pistols are the notch sights and peep sights. Telescopic sights are also used by shooters. The notch sights and peep sights have several problems caused by the way they are designed. Some of these problems are listed below:

1. The sights are not easy to learn to use and require considerable practice and expense for an individual to master.

2. The solid construction of the sight causes a part of the target and the surrounding area to be blocked from the view of the shooter.

3. It is difficult to keep the sights aligned while moving the gun, making it harder to hit a moving target.

4. The solid construction of the sight causes it to be ineffective in low light conditions such as dusk or dawn.

5. Rapid target acquisition is difficult because of the nature of the alignment of the sights.

Telescopic sights restrict the shooter's view of the surrounding area, are slow to sight and are expensive.

Inventors have obtained patents on designs for sights that attempt to overcome some of these problems. Cooper, Howells, and Wing, and others have obtained patents from designs which use transparent material to overcome the problem of restricted visibility. Russell, Trippi, and Dindinger have obtained patents for designs that use open sights to overcome the problem of restricted visibility. Howells, Rickert Plisk, and others have patent designs which deal with the problem of ineffectiveness in low light conditions.

It is to be noted that the sights are attached to the gun and the target is normally a large distance from the shooter. Because of the distance involved, a minor improvement in the sight can mean a major improvement in the ability of the shooter to hit the target.

OBJECTIVES OF THE INVENTION

In spite of all the problems associated with the notch sights and the peep sights, only the telescopic sights of the designs patented appear to be widely accepted replacements for them. It is therefore an objective of the invention to provide a novel type of gun sight which solves these and other problems associated with the notch sights, peep sights, and other telescopic sights. More specifically, it is an objective of this invention to provide a gun sight which satisfies the following:

1. It is simple to manufacture and can be sold at a price that will not prohibit its use.

2. It is easy to learn to use and will require a minimum of practice to become proficient with its use.

3. The shooter's view of the target and the area surrounding the target is not unnecessarily obstructed.

4. Vertical and horizontal alignment of the gun with the target is made easier and quicker.

5. It aids the eye of the shooter to change from focusing upon the sight to focusing upon the target.

6. It aids the shooter in rapid target acquisition and will be useful to a shooter while aiming at a moving target.

7. It will perform well in low light conditions, such as dusk or dawn.

INVENTION

In accordance with these and other objectives, the invention relates to a new and different type of gun sight that is designed to work with the eye of the shooter. The rear sight is a modification of the old notch sight with the thickness of the sight increased, a rectangular channel is cut in the top of the sight, and as much as possible of the interior of the sight is removed. The front sight consists of a small threaded rod attached to a small tube. The threaded rod adjusts the tube upward and downward in a base attached to the barrel of a gun.

The combination of the front and rear sights is unique and provides a novel means of alignment of the gun with the target. From the eye of the shooter the channel cut in the top of the rear sight resembles a cross section of a small open box and the tube part of the front sight resembles a small open circle. The gun is proper aligned horizontally and vertically when the circle (tube part of the front sight) is viewed as sitting in the box (the channel cut into the top of the rear sight). Whatever the gun is aimed at can then be seen through the center of the small open circle.

The advantages of this new gun sight and novel means of alignment are as follows:

1. The eye picks up very easily and quickly the curve of the open circle set against the straight lines inside the open box.

2. It is simple to learn to use the gun sight and little practice will be required to master its use.

3. It is easy to keep the front and rear sights properly aligned during movement of the gun. Thus, the sight can be used on a moving target.

4. The sight aids the eye of the shooter during the change of focus from the sight to the target.

5. The sight can be kept in view and properly aligned while the eye is focusing upon the target.

6. Rapid target acquisition is possible because of the ease of the alignment of the sights with the target.

Other objectives and advantages of the present invention will be apparent from the following detailed description and accompanying drawings.

In the drawings:

FIG. 1 is a perspective view of a preferred embodiment of the rear sight.

FIG. 2 is a side view of the rear sight.

FIG. 3 is a perspective view of the tube part of the front sight.

FIG. 4 is a perspective view of the base part of the front sight.

FIG. 5 is a shooter's view of the front sight and rear sight when the sights are properly aligned.

The sight can be constructed from non-transparent materials such as steel aluminum, or plastics. It could be constructed from a transparent material such as polycarbonate. The rear sight is described as four small rectangular plates joined together. It can be constructed in this manner, or it can be formed by a casting process where the material is heated to a liquid state or it can be formed by machine tooling a solid block of material. The front sight can be constructed by a casting process or machine tooling.

FIG. 1 is a perspective view of a preferred form of the rear sight. The base of the sight 1 is a small rectangular plate. Dovetail grooves 2 are cut into the bottom of the base so that the rear sight can be mounted into a dovetail channel cut into the barrel of the rifle or pistol. It is to be noted that other means of mounting the sight are possible and the sight could be mounted to an adjustable mechanism which is attached to the barrel of the gun.

The walls of the sight 3 are small rectangular plates joining the base of the sight 1 to the top of the sight 4. The length of the edge of the wall facing the shooter 5 is longer than the length of the edge 6 facing the front sight. This is necessary in order for the top of the sight 4 to be angled downward toward the front of the gun. The angling downward causes the rear sight to appear as a thin flat surface and produces a sharp image to the eye of the shooter.

The top of the sight 4 is a small rectangular plate with its upper surface angled downward towards the front of the gun. The upper part of the rectangular plate has a small channel 7 cut into its center. The bottom of the small channel 7 is a flat rectangular surface and the sides of the channel are cut at 90 degree angles to the upper surface of the small rectangular plate. The depth and width of the channel are determined by the size of the tube part of the front side. (See FIG. 3) The size of the channel is such that from the view of the shooter the lower part of the outside diameter of the tube appears to sit in the channel 7.

When the base, two side walls, and top of the rear sight are constructed in this manner and then joined together, the rear sight will have an open interior 8. This open interior 8 enables the shooter to see through the rear sight and does not unnecessarily obstruct the shooter's view of the target and the surrounding area.

FIG. 2 is a side view of the rear sight. The dovetail grooves 2 are shown at the bottom of the sight. The side 5 facing the shooter is slightly longer than the side 6 facing the front of the gun. The top 4 is seen to be angled slightly downward toward the front of the gun.

FIG. 3 is a perspective view of the tube part of the front sight. The tube 9 is attached to a small rod 11. The rod is threaded so that it will adjust upward and downward in a threaded hole in the base part of the front sight. (See FIG. 4) This upward and downward adjustment of the tube 9 makes the sight adjustable for shooting at different distances.

From the eye of the shooter the outside of the tube 9 appears to be the outer edge of a small circle. The interior of the tube 10 being open causes the tube to resemble a small open circle to the eye of the shooter. The threaded rod 11 is grooved at a point 12 so that a small set screw (See FIG. 4) when tightened will cause the tube 9 to be properly aligned with the rear sight.

FIG. 4 is a perspective view of the base part of a front sight that is designed to be attached to a gun by means of a dovetail groove cut into the barrel of the gun. The base part of the front sight can be attached to the barrel of a gun by other means such as small screws.

The dovetail slots 15 are at the bottom of the base 16. A small hole 13 is drilled vertically through the base. The small hole 13 is threaded so that the small rod attached to the tube part of the front sight (See FIG. 3) will screw upward or downward in the base. Another hole 17 is drilled into the side of the base. The hole 17 is drilled so that it reaches hole 13. The hole 17 is threaded so that a small set screw 18 will screw into the side. When the tube part of the front sight (See FIG. 4) is properly aligned, the end of the small set screw will fit into a groove cut into the threaded rod that is attached to the tube part of the front sight. As much as possible of the base part of the front sight 14 is angled upward to increase the visibility of the shooter.

FIG. 5 is a shooter's view of the front and rear sights when the gun is properly aligned. The tube part of the front sight appears to be a small open circle 10. The channel cut in the top of the rear sight 7 appears as a cross section of a small open box. The top part of the rear sight 7 is constructed so that to the shooter it appears to be at a point one-half of the height of the small circle 9. This aids the eye of the shooter to determine where the center of the small open circle 10 is located, thus improving the ability of the shooter to focus the sight on the target.

The part of the rear sight facing the shooter 5 appears to be a flat narrow surface with the interior of the rear sight open. This allows the shooter to see through the rear sight, again aiding the shooter in aiming the gun.

The gun is properly aligned when the small circle 9 appears to be sitting in the small open box 7. The target on which the gun is aimed is seen at the center of the small circle 10. A target is easily and quickly located by the shooter, since the sights are easy to align and the sight provides a minimum of obstruction of the view of the target and the area surrounding the target.

It is easy for a shooter to tell when the gun is properly aligned because the round outer edge of the small circle 9 is seen against the straight edges of the open box 7. This makes it possible to move the gun and at the same time keep the sights aligned. Since the target is easily viewed through the center of the small circle 10, rapid target acquisition is possible and the sights can be used to aim at a moving object.

What is claimed is:

1. A gun sight consisting of a) a front sight comprising a small threaded rod attached to a small tube which adjusts vertically in a front sight base attached to a barrell of a gun;

b) a rear sight comprising a rear sight base attached to the gun, a top plate which has at its center a small rectangular channel, the width and depth of the channel being dimensioned to match the lower half of the outside circumference of the small tube when the front sight is viewed through the rear sight, and two side walls which join the rear sight base to the top plate forming an open interior;

which in combination produces an image of a small open circle sitting in a cross-section of a small open box to assist with the horizontal and vertical alignment of the gun with a target.

2. The gun sight of claim 1 wherein the front sight and the rear sight are made entirely of transparent material.

3. The gun sight of claim 1 wherein each of the side walls has a top portion, each said top portion being angled downwards toward the front sight so as to make the rear sight appear as a thin flat surface.

* * * * *